United States Patent [19]

Ehnström

[11] Patent Number: 4,634,416

[45] Date of Patent: Jan. 6, 1987

[54] OUTLET ARRANGEMENT FOR A CENTRIFUGAL SEPARATOR

[75] Inventor: Lars Ehnström, Tullinge, Sweden

[73] Assignee: Alfa-Laval AB, Tumba, Sweden

[21] Appl. No.: 695,452

[22] PCT Filed: May 30, 1984

[86] PCT No.: PCT/SE84/00207

§ 371 Date: Dec. 12, 1984

§ 102(e) Date: Dec. 12, 1984

[87] PCT Pub. No.: WO85/00022

PCT Pub. Date: Jan. 3, 1985

[30] Foreign Application Priority Data

Jun. 14, 1983 [SE] Sweden ..... 8303379

[51] Int. Cl.[4] ..... B04B 11/00

[52] U.S. Cl. ..... 494/27; 494/38; 494/56

[58] Field of Search ..... 494/2, 56, 57, 58, 27, 494/30, 35, 41, 40, 38; 210/360.1, 360.2, 363, 369

[56] References Cited

U.S. PATENT DOCUMENTS

| | | | |
|---|---|---|---|
| 2,344,888 | 3/1944 | Lindgren | 494/57 |
| 3,410,481 | 11/1968 | Dahlberg | 494/56 |
| 3,426,967 | 2/1969 | Roberts | 494/56 |
| 3,468,475 | 9/1969 | Thylefors | 494/56 |
| 4,014,497 | 3/1977 | Spiewok | 494/56 |

FOREIGN PATENT DOCUMENTS 48615 9/1889 Fed. Rep. of Germany .

*Primary Examiner*—Robert W. Jenkins

*Attorney, Agent, or Firm*—Cyrus S. Hapgood

[57] ABSTRACT

At a centrifugal separator the centrifuge rotor has an inlet (24) to a separating chamber (4) for a fluid mixture of components to be separated, and means for removing of one separated component from another during the operation of the rotor. Said means comprise an outlet member (15) which is arranged to be entrained in rotation by fluid having been supplied to the rotor but which—at least intermittently—may be caused to rotate at a lower speed than said fluid. A channel (16) extends through the outlet member (15) from a point in the rotor, where the separated component is situated, to a reception place therefor. The reception place may be arranged either within or outside the rotor.

17 Claims, 6 Drawing Figures

OUTLET ARRANGEMENT FOR A CENTRIFUGAL SEPARATOR

The present invention relates to a centrifugal separator, the rotor of which has an inlet for a fluid mixture of components to be separated within the separating chamber of the rotor, and means for removing one separated component from another during the operation of the rotor.

At previously known centrifugal separators of this kind one of the separated components generally is removed from another by being conducted to a central chamber within the rotor, from where it is removed either through an overflow outlet or through a so called paring member.

This method of removing one separated component from another during the operation of the rotor is not suitable in connection with so called ultra speed centrifugation, i.e. in connection with extremely rapidly rotating rotors. It is also not suitable in connections where the amount of a separated component, that is removed from a rotor, has to be changed during the operation of the rotor, and perhaps sometimes has to be reduced to zero.

One object of the present invention is to provide an outlet arrangement for a centrifugal separator, which during the operation of the centrifuge rotor makes it possible to control easily the amount of separated component that is removed from the separating chamber of the rotor.

Another object of the invention is to provide an outlet arrangement which is suitable for extremely rapidly rotating centrifuge rotors.

A further object of the invention is to provide an outlet arrangement having a relatively small energy consumption, when it is utilized, and substantially no energy consumption at all when it is not utilized.

Finally, one object of the invention is to provide an outlet arrangement by means of which a separated component may be removed from the separating chamber of the rotor in a gentle way without being mixed up with air or other gases surrounding the rotor.

These objects may be fulfilled according to the invention at a centrifugal separator of the initially defined kind by having an outlet member arranged in the rotor such that it is entrained in rotation around the rotor axis during the operation of the rotor by fluid having been supplied to the rotor, by having at least one outlet channel extending radially inwards through the outlet member from a point in the rotor, where one of the separated components is situated, to a place in the rotor where the channel terminates, and by having means arranged to counteract the entrainment of the outlet member to such an extent that the latter will rotate at a smaller velocity than said fluid within the rotor and, thereby, a flow of said separated component is obtained through the outlet channel to a separate member at least partly contained in the rotor and having a cavity forming a reception place for said component.

At a centrifugal separator designed in this way said flow through the outlet channel will come up as a consequence of the overpressure to which the separated component is subjected in the rotor by the prevailing centrifugal force due to the rotation of the rotor. The liquid pressure prevailing within the outlet channel will thus be lower than the liquid pressure in the rotor outside the outlet channel, when the outlet member is caused to rotate at a lower speed than the liquid in the rotor.

Within the scope of the invention said reception place for the separated component may be situated either within or outside the rotor. Thus, the outlet member may extend out of the rotor or only to the centre of the rotor. In the latter case said outlet channel may open into a chamber, which within the rotor is formed by a nonrotating member extending into the rotor.

In one embodiment of the invention, the outlet member extends from the separating chamber to the center of the rotor where the separate member is releasably connected to the outlet member to provide a closed flow path between the two. Thus, when a separated component has been collected in the cavity, the separate member can be easily detached from the outlet member and removed from the rotor.

The invention will be described further below with reference to the accompanying drawing. Therein FIG. 1 shows a section of a centrifuge rotor provided with two outlet arrangements according to the invention.

Figure 1:
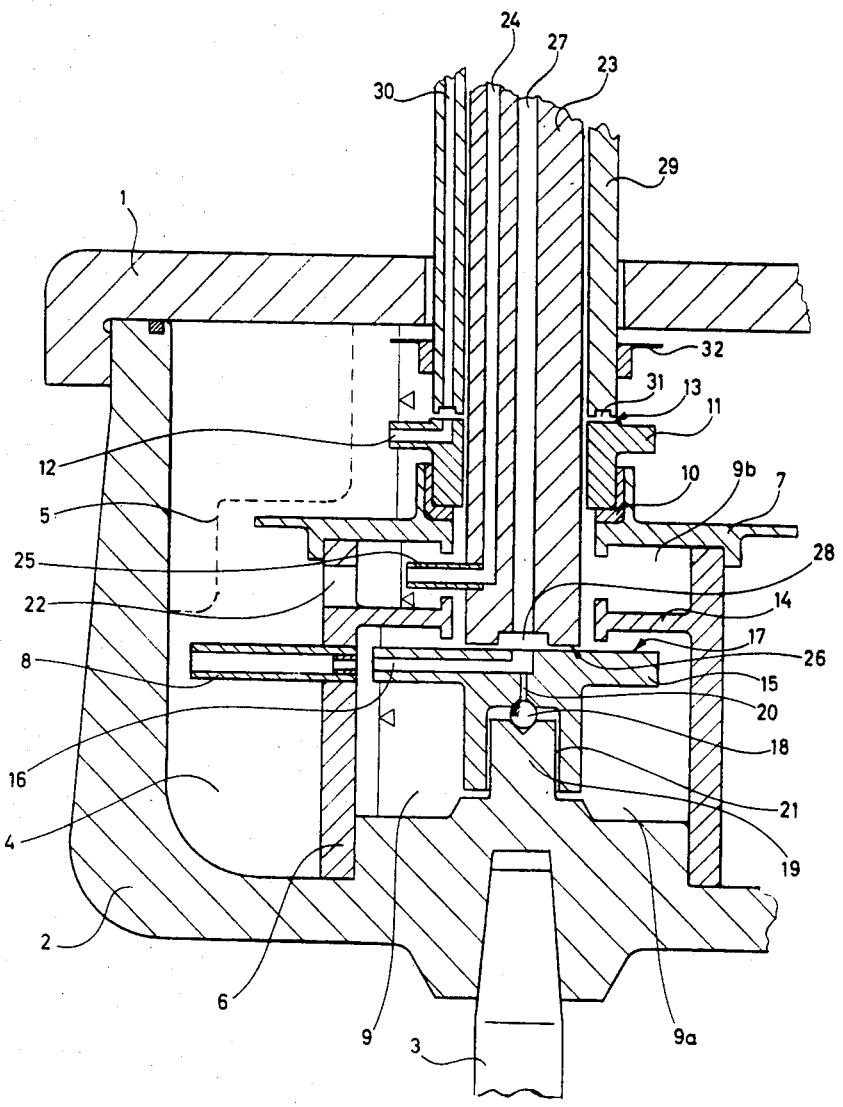

In FIG. 1 there is shown a centrifuge rotor consisting of two rotor parts 1 and 2 connected with each other. The rotor part 2 is supported by a vertical drive shaft 3.

The rotor parts 1 and 2 confine a separating chamber 4 in which a liquid body is intended to rotate together with the rotor. For entrainment of the liquid body one or both of the rotor parts may have radial flanges. One flange of this kind is illustrated in FIG. 1 by means of a dash-line 5.

The rotor part 2 forming the bottom of the separating chamber 4 supports (i.e. is firmly connected with) a sleeve formed body 6 arranged coaxially with the rotor. The body 6 in turn supports a circular plate 7 at its upper end, and also a number of radial pipes 8 on its jacket, which pipes connect the chamber enclosed by the body 6 in the rotor with the radially outermost part of the separating chamber 4.

Said chamber in the rotor, enclosed by the body 6, has been designated 9 in FIG. 1.

The plate 7 shielding the connection between the chamber 9 and the upper part of the separating chamber 4 supports on its upper side through a slide bearing 10 an annular outlet member 11. The outlet member 11 thus is rotatable relative to the plate 7. A number of channels 12 extend from the periphery of the outlet member 11 radially inwards to an axially directed surface 13 of the member.

Said chamber 9 within the sleeve-formed body 6 by means of an annular flange 14 carried by the body 6 is divided in a lower chamber **9*a* and an upper chamber 9*b*. In the lower chamber 9*a* there is arranged a second circular outlet member 15 having a number of channels 16 extending radially inwards from the periphery to the centre of the outlet member. The channels 16 open in an axially upwards directed surface 17 of the outlet member 15, which on its underneath side through a layer 18 is rotatably journalled on a pin 19 standing up from the rotor part 2. Between the channels 16 and the bearing 18 there is extending a throttled connection 20, and a certain clearance 21 is present between the outlet member 15 and the pin 19**.

Into the upper chamber 9b, which communicates with the rotor separating chamber 4 through openings 22 in the body 6, there is extending from above a member 23 having an inlet channel 24 for liquid to be centrifuged within the rotor. At the opening of the channel 24 in the chamber 9b there is arranged a short pipe 25 carried by the inlet member 23, and extending substantially radially outwards therefrom.

The member 23 extends axially through the upper chamber 9b into the lower chamber 9a, so that an axially downwards directed surface 26 thereof will be situated opposite to the upwardly directed surface 17 of the outlet member 15. Axially and centrally through the member 23 there is extending a further channel 27, the lower end of which opens into a recess 28 situated opposite to the area in which the channels 16 of the outlet member 15 open in the surface 17.

The member 23 is prevented from rotating around the axis of the rotor but is axially movable, so that the gap between the surfaces 17 and 26 may be made larger or smaller. Further, the member 23 is surrounded by an annular further member 29, which is also prevented from rotating around the axis of the rotor, but is axially movable—independent of the member 23—relative to the rotor parts 1 and 2.

The annular further member 29 has an axially extending channel 30 opening in an annular recess 31 that is formed in the axially downwards directed surface of the member 29. The recess 31 has an extension such that part of it is situated opposite to the openings of the channels 12 of the outlet member 11 in the surface 13, independent of the angular position of the outlet member 11 relative to the member 29.

The member 29 supports at its portion situated within the rotor an annular flange 32 which extends outwards to a certain radial level in the separating chamber 4.

The centrifugal separator in FIG. 1 operates in the following manner.

A mixture of two liquids to be separated is supplied intermittently or continuously through the channel 24 and the pipe 25 into the chamber 9b. From there the mixture will flow further on through the openings 22 to the separating chamber 4, wherein the different liquids are gradually separated. The liquid having the largest density is then collecting at the periphery of the separating chamber, from where it flows through the pipes 8 to the chamber 9a, whereas the liquid having the lowest density is collected more close to the centre of the rotor.

When a certain separation has occurred the liquid surfaces in the separating chamber 4 and in the chambers 9a and 9b will take positions at somewhat different levels, which in FIG. 1 are indicated by small triangles.

As soon as the liquid surface in the chamber 9a has moved radially inwards to the outlet member 15, the latter is entrained in the rotation of the liquid and will get substantially the same rotational speed as the liquid. In the same way the outlet member 11 will be caused to rotate substantially with the same speed as the liquid in the separating chamber 4. In the chamber 9b the pipe 25 is dimensioned such that it will not be immerged into the liquid body rotating within this chamber.

When separated light liquid component is to be removed from the separating chamber 4, the sleeve-formed member 29 is moved axially towards the rotating outlet member 11, until arising friction forces between the two members will reduce in a desired degree the rotational speed of the member 11. In other words the member 11 is prevented from rotating with the same high speed as the liquid in the separating chamber.

As a consequence hereof the static liquid pressure, which by the rotation of the liquid is prevailing within the separating chamber at the opening of the channel 12 in the liquid, will force liquid radially inwards into the channel 12. This liquid will flow to the recess 31 in the sleeve formed member 29 and thence further on through the channel 30 out of the rotor.

Part of the liquid beeing forced into the channel 12 will flow back to the separating chamber 4 through the gap which exists between the sleeve-formed member 29 and the surface 13 of the outlet member 11. This liquid flowing back forms a thin liquid film between the members 11 and 29, which prevents a direct mechanical contact between the members.

It is possible to control the amount of separated liquid to be discharged from the rotor by pressing with a larger or smaller force the member 29 towards the member 11, so that the rotational speed of the latter is changed. The smaller the rotational speed of the member 11, the larger flow will be obtained through the channels 12 and 30.

In a corresponding manner separated heavy liquid component may be removed from the chamber 9a by displacing the central member 23 axially towards the rotating outlet member 15. The rotational speed of this member will then be reduced, liquid being forced radially inwards through the channel 16, the recess 28, and out of the rotor through the channel 27. A certain small stream will flow back to the chamber 9a through the gap between the members 15 and 23. Also, a certain small flow will run through the channel 20 to the bearing 18 and thence through the annular slot 21 back to the chamber 9a. The last mentioned flow will contribute to the journalling of the outlet member 15 on the pin 19. (A corresponding small flow of separated light liquid component may be arranged to the slide bearing 10 between the outlet member 11 and the plate 7).

As can be seen from FIG. 1 the plate 7 extends some distance radially outwards into the separating chamber outside the sleeve formed body 6. The reason therefore is that no part of the liquid mixture flowing out through the opening 22 should be able to flow directly to the outlet for separated light liquid component.

The thin annular flange 32 in the uppermost part of the separating chamber extends radially outside the liquid surface formed in the separating chamber, whereby only an insignificant part thereof will be exposed to the atmosphere outside of the rotor. This is advantageous particularly in such cases when the pressure around the rotor is lower than normal atmospheric pressure.

The centrifugal separator shown in FIG. 1 is well suited for so called ultraspeed centrifugation, when the rotational speed of the rotor may arise to 50.000 r/min., or more. In connections like that the rotor is enclosed in an evacuated chamber, in which the gas pressure is very close to vacuum. The nonrotatable members 23 and 29 are then extending through the confining wall around the evacuated chamber, which is simple to achieve with complete tightness and with the maintained possibility for the members to move axially to and from the rotating outlet members 11 and 15, respectively.

Figure 2:
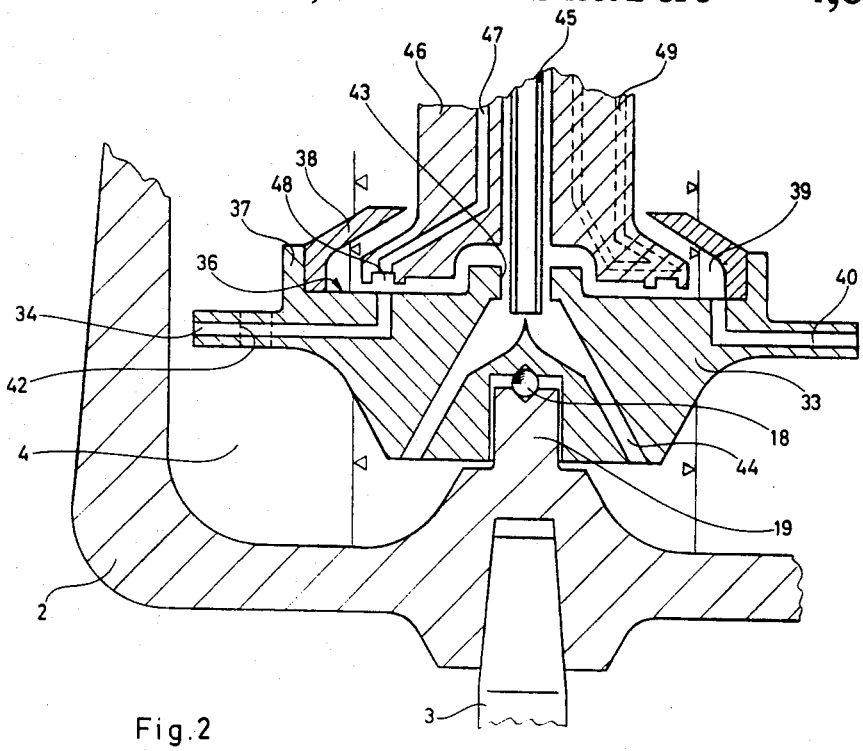
FIG. 2 shows a modified embodiment of an outlet arrangement according to the invention.

In FIG. 2 there is shown a modified embodiment of an outlet arrangement according to the invention. The same reference numerals have been used in FIG. 2 as in FIG. 1 for corresponding details of the centrifugal separator. On the pin 19 there is journalled by means of the bearing 18 an outlet member 33. This outlet member having the form of a disc extends outwards to the radially outermost part of the separating chamber. From the periphery of the outlet member 33 there are extending several channels 34 radially inwards in the outlet member to openings 35 situated at the same distance from the axis of the rotor. The openings 35 are situated in an upwards directed plane surface 36 of the outlet member 33.

Around the plane surface 36 there is extending an axially upwards directed flange 37, inside of which there is arranged an annular member 38. The member 38 forms together with a part of the plane surface 36 an annular groove 39 open towards the rotor axis. From the radially outermost part of this groove there are extending a number of channels 40 through the outlet member 33 to the periphery thereof. The channels 40 are distributed around the rotor axis between the previously mentioned channels 34. This is most evidently seen from FIG. 3, which is a plane view of the outlet member 33, seen from above, without the annular member 38. The openings of the channels 40 in the plane surface 36 are designated 41 in FIG. 3.

Radially outside the flange 37 the outlet member 33 has a number of axially through holes 42.

Figure 3:
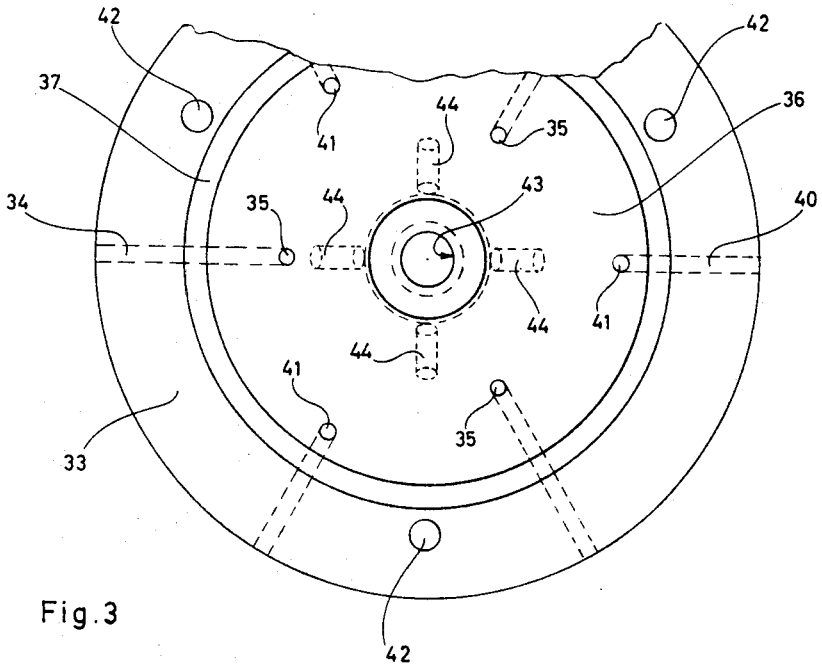
FIG. 3 is a plane view of a part of the outlet arrangement in FIG. 2.

At the embodiment according to FIGS. 2 and 3 the outlet member 33 also constitutes a part of the rotor equipment for supply of liquid mixture to the separating chamber. Thus, the outlet member has a central bore 43, which is open axially upwards and which at its lower part forms four different channels 44 opening at the underneath side of the outlet member 33. Inserted from above into the bore 43 there is a stationary inlet pipe 45 for liquid mixture to be centrifuged within the rotor.

The inlet pipe 45 is surrounded by a nonrotatable but axially displaceable separate member 46. Through this there are extending axially a number of channels 47 which at their lower ends open into an annular recess 48 in the axially downwards directed surface of the member 46. The annular recess 48, which extends coaxially with the rotor axis, is arranged such that all the openings 35 of the channels 34 are located opposite to parts of the recess 48.

A further channel 49 in the separate member 46 has been indicated by dotted lines. This channel constitutes one of several similar channels intended to be flown through by a cooling medium.

The arrangement in FIGS. 2 and 3 operates in the following manner.

A liquid mixture is supplied through the inlet pipe 45 and is distributed through the channels 44 to different parts of the separating chamber 4. The mixture is distributed axially in the separating chamber through the holes 42 in the outlet member 33. After some time of centrifugation liquid having a relatively high density is collected in the radially outermost part of the separating chamber 4, from where it flows radially inwards through the channels 34 in the outlet member 33. This outlet member is entrained in rotation by the liquid in the separating chamber, but it is prevented from rotating with the same velocity as the liquid as long as new liquid mixture is supplied through the pipe 45. The rotational speed of the member 33 is reduced, namely, by the incoming flow of liquid mixture, which by means of the very member 33 shall be caused to rotate.

Separated liquid flowing radially inwards in the channels 34 leaves the openings 35 of these channels and flows out into the groove 39 formed by the members 33 and 38, from where it flows back into the radially outermost part of the separating chamber 4 through the channels 40 in the member 33.

When separated liquid with high density is to be discharged from the rotor, the separate member 46 is displaced axially downwards until the gap between this member and the rotating outlet member 33 is so small that separated liquid may continue to flow from the channels 34 through the recess 48 to and out through the channels 47. Depending upon the size of the flow which is desired out through the channels 47, the separate member 46 may be pressed by a varying force axially towards the rotating outlet member 33.

It has been described above how the rotational speed of the rotating outlet member 33 can be influenced in two different ways, firstly by means of the supplied liquid mixture, and secondly by means of the axially movable second separate member 46. Also other possibilities are available for such influence within the scope of the present invention. Thus, a member separate from the nonrotating outlet member may be used with the single task to accomplish such influence—either in a corresponding way as already described or in some other way. For instance, influence may be accomplished in an electromagnetic way, for instance a coil connected to a voltage source being arranged in the nonrotating separate member 46, whereas another coil, or a magnet, is arranged in the rotating outlet member 33. In the most simple case the arrangement to counteract entrainment of the rotating outlet member consists of a friction clutch of one kind or another located between the outlet member and the rotor body. Several other ways are possible.

Figure 4:
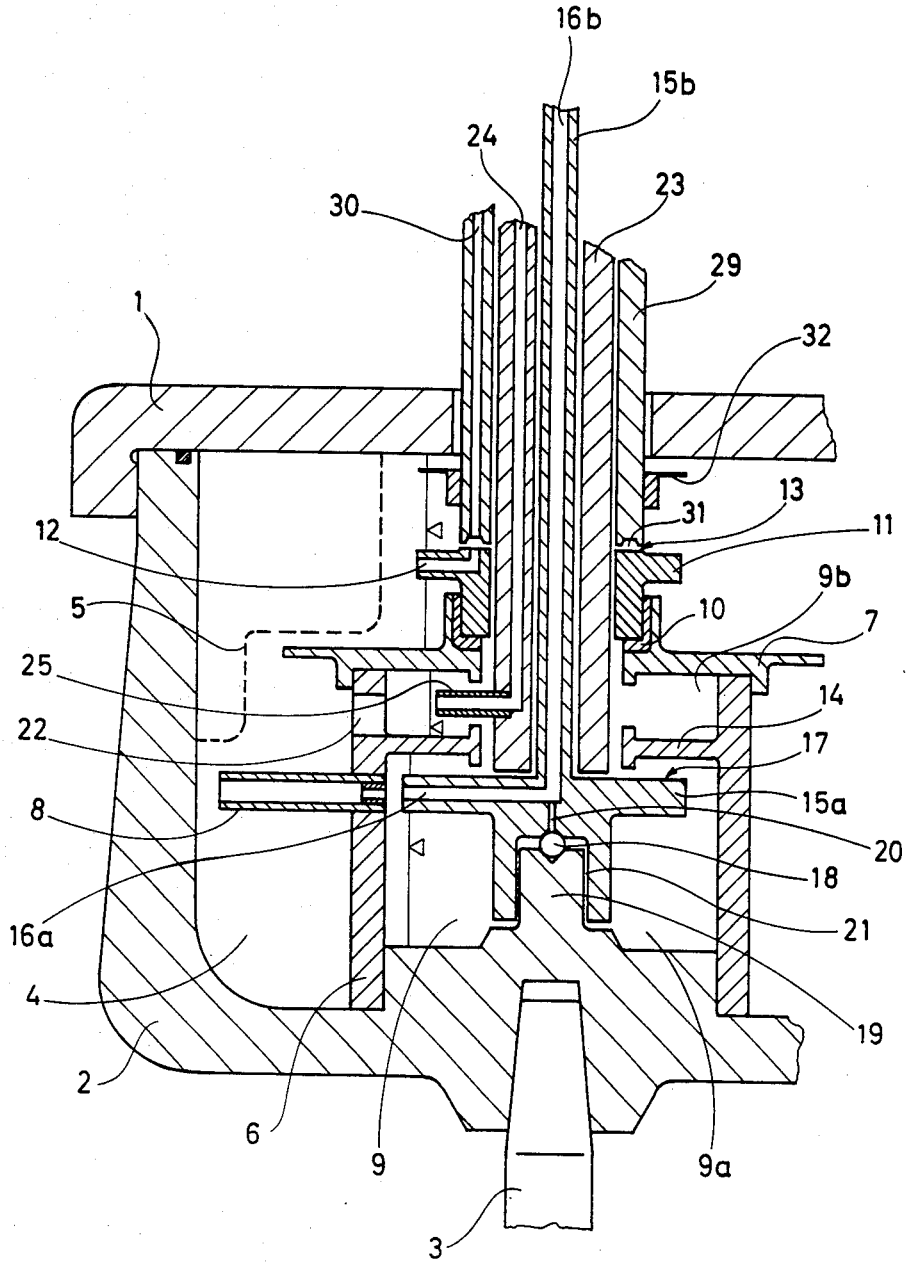
FIGS. 4–6 show further modifications of the outlet arrangement according to the invention.

FIG. 4 shows a centrifuge rotor substantially similar to the one shown in FIG. 1. Corresponding parts, therefore, have been given the same numeral references. The centrifuge rotor in FIG. 4 is provided with a modified outlet arrangement for separated heavy liquid component, comprising a rotatable outlet member which consists of a disc formed part **15*a* and a tube formed part 15*b*. The tube formed part 15*b* extends axially out of the rotor. Through the parts 15*a* and 15*b* of the outlet member there are extending channels 16*a* and 16*b***, respectively.

The outlet member **15*a*, 15*b*, like the outlet member 15 in FIG. 1, is arranged to be entrained in rotation by liquid present within the chamber 9*a*. Means (not shown) are arranged outside the rotor to counteract to a desired degree the entrainment of the outlet member 15*a*, 15*b*, so that separated heavy liquid component is caused to flow out of the rotor through the channels 16*a* and 16*b***.

Figure 5:
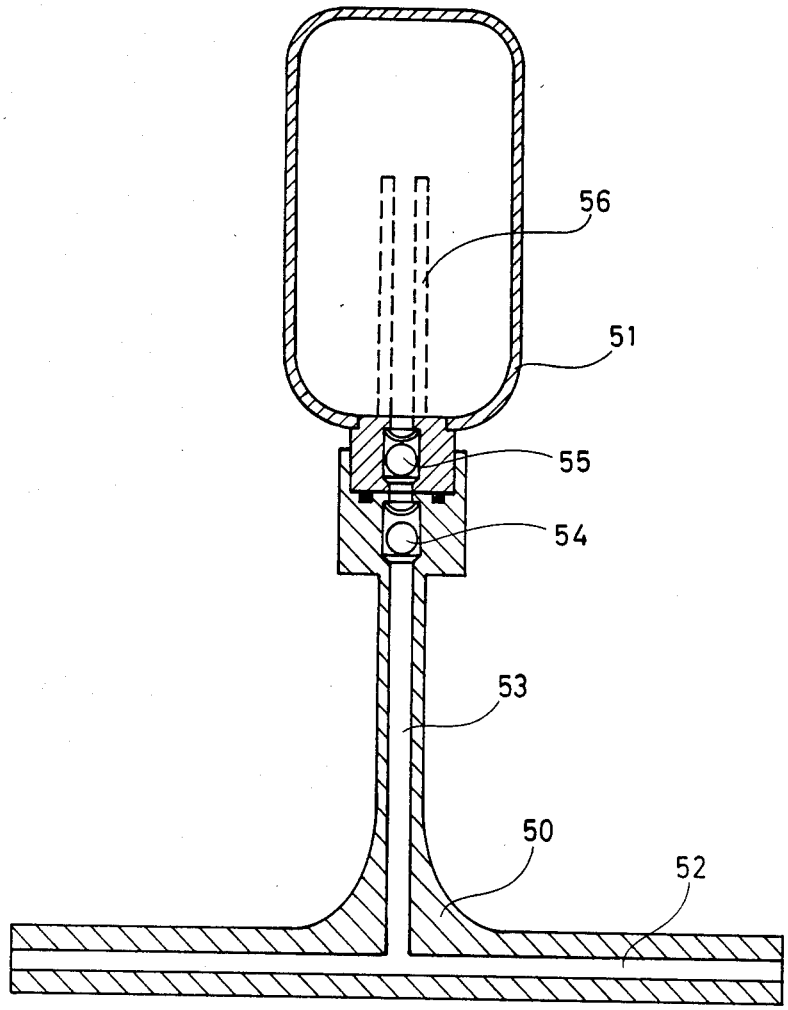

In FIG. 5 there is shown a modified outlet member 50 comprising a disc formed lower portion and a tube formed upper portion. Channels 52 and 53 communicating with each other extend through these portions.

By means of a simple clutch said upper portion is releasibly connected with the separate member 51, which has the form of a container. The container has a downwardly directed opening which communicates with the channels 53 and 52 in the outlet member. Two check valves 54 and 55 are arranged in the parts 50 and 51, respectively, on each side and near said clutch. The check valves are arranged to allow liquid flow to the container 51 but to prevent liquid flow in the opposite direction.

A tube 56 (shown by dotted lines) which connects the downwardly directed opening of the container 51 with the centre portion of the container, may serve as an alternative to the check valve 55 for preventing fluid from running out of the container 51 when released from said part 50.

During the operation of the rotor both parts 50 and 51 are intended to be rotated by liquid having been supplied to the rotor. By special means (not shown) the entrainment of the outlet member is intended to be counteracted to a desired degree, so that separated liquid will flow through the channels 52 and 53 into the container 51.

After some time of separation the container 51 may be released from the outlet member, for instance to be replaced by a new container to be filled by separated liquid.

The tube formed portion of the outlet member 50 may have a varying length, so that the container 51 could be arranged either within or outside the rotor.

Figure 6:
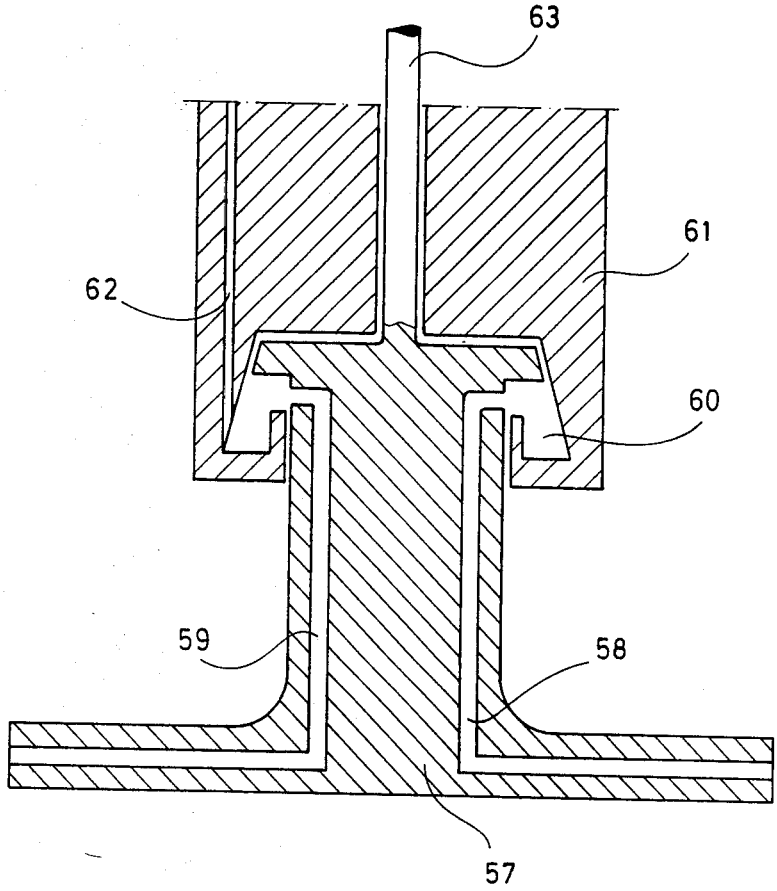

In FIG. 6 there is shown a further embodiment of an outlet arrangement according to the invention. In a rotatable outlet member 57 there are extending from its radially-outermost part outlet channels 58, 59, which open into a central chamber 60. The chamber 60 is annular and formed by a stationary member 61 extending into the rotor. From the radially outermost part of the chamber 60 there is extending one or more channels 62 axially through the stationary member 61 out of the rotor.

Through a central bore in the stationary member 61 there is extending a spindle 63 connected with the outlet member 57. Means (not shown) are situated outside the rotor and arranged to counteract the rotation of the outlet member as described previously.

When the outlet member 57 is entrained in rotation by liquid having been supplied to the rotor, and this entrainment is counteracted to a desired degree, a separated liquid flows through the channels 58, 59 to the chamber 60. In spite of the fact that the member 61 is stationary the separated liquid entering the chamber 60 will form an annular liquid body within the chamber 60, which body is rotating around the rotor axis. Due to the liquid pressure then prevailing in the radially outermost part of the chamber 60, the separated liquid will leave the chamber 60 and flow out of the rotor through the axial channel 62.

It has been presumed above that two liquid components are separated from each other. However, it should not be excluded that some embodiment of the present invention, for instance the embodiment according to FIG. 4, could be applied on a centrifugal separator for the separation of gaseous fluids.

I claim:

1. A centrifugal separator comprising a rotor forming a separating chamber and having an inlet for supplying a mixture of fluid components to said chamber, the rotor being rotatable about an axis to rotate said mixture and thereby divide the same into separated fluid components located at different respective regions in the rotor, an outlet member mounted for rotation relative to the rotor and positioned for entrainment in rotation about said axis by fluid supplied to the rotor, said outlet member having an outlet channel extending radially inward from a said region of one of said components and terminating at its inner end within the rotor, and means for counteracting said entrainment to cause the outlet member to rotate at a lower speed than said fluid in the rotor, thereby inducing a flow of said one component through said outlet channel, the rotor at least partly containing a member separate from said outlet member and located adjacent said inner end of the outlet channel, said separate member having a cavity for receiving said one component from the outlet channel.

2. The separator of claim 1, in which said counteracting means includes said separate member.

3. The separator of claim 1, in which said outlet member extends from said separating chamber to the center of the rotor, said separate member being releasable from the rotor for discharge of fluid collected in the cavity.

4. The separator of claim 3, in which the cavity has an inlet which opens into the cavity substantially above its bottom, whereby liquid will remain in the cavity when rotation of the outlet member ceases.

5. The separator of claim 3, comprising also a check valve in the outlet channel operable to allow flow in the direction of the cavity and prevent flow in the opposite direction.

6. The separator of claim 3, comprising also a check valve in each of said separate member and outlet channel, said valves being operable to allow flow in the direction of said cavity and prevent flow in the opposite direction.

7. The separator of claim 1, in which said separate member is a non-rotating member, the outlet channel of said outlet member opening into said cavity.

8. The separator of claim 7, in which said cavity is annular and formed to retain liquid rotating about the rotor axis, said non-rotating member having a channel extending out of the rotor from said cavity.

9. The separator of claim 1, in which said outlet member has a first surface located closer to said axis than is the region of said one component, said outlet channel extending from the last said region to a point in said first surface, said counteracting means including said separate member having a second surface for forming a small gap between said surfaces, said separate member having a second channel extending from said second surface, said gap being small enough to allow at least part of the liquid flowing through said channel of the outlet member, when said entrainment is being counteracted, to pass said gap and flow further through said second channel.

10. The separator of claim 1, in which said counteracting means includes a wall of a passage located in said outlet member and through which mixture from said inlet flows before entering the separating chamber, the mixture acting through said wall to oppose said entrainment.

11. The separator of claim 1, in which said outlet member has a first surface located closer to said axis than is the region of said one component, said outlet channel extending from the last said region to a point in said first surface, said separate member having a second surface for forming a small gap between said surfaces, said separate member having a second channel extending from said second surface, said gap being small enough to allow at least part of the liquid flowing through said channel of the outlet member, when said entrainment is being counteracted, to pass said gap and flow further through said second channel.

12. The separator of claim 9 or 11, in which said gap is located within the rotor, said separate member extending out of the rotor.

13. The separator of claim 9 or 11, in which said gap is so small that rotation of the outlet member is retarded by friction forces arising in the gap.

14. The separator of claim 9 or 11, in which said outlet member has a part in the form of a body of revolution positioned for immersion in said fluid.

15. The separator of claim 9 or 11, in which at least one of said members has a recess located in its said surface and into which the channel of said one member opens, said recess having an extension such that in each position of one member relative to the other, while one member is rotating, the recess is situated opposite the opening of the channel of the other member.

16. The separator of claim 15, in which the channel of one of said members has an opening coaxial with the rotor axis, the other member having a recess located opposite said opening and in which the channel of said other member opens.

17. The separator of claim 9 or 11, in which said separate member is movable toward and away from the outlet member for intermittent removal of one separated component from the rotor.

* * * * *